United States Patent [19]

Schär

[11] 4,020,997

[45] May 3, 1977

[54] APPARATUS FOR PRODUCING WASTE AND RESERVE WINDINGS ON BOBBIN TUBES ON WINDING MACHINES

[75] Inventor: Hugo Schär, Dattlikon, Switzerland

[73] Assignee: Rieter Machine Works, Ltd., Winterthur, Switzerland

[22] Filed: Aug. 1, 1975

[21] Appl. No.: 601,195

[30] Foreign Application Priority Data

Sept. 12, 1974 Switzerland ..... 12407/74

[52] U.S. Cl. ..... 242/18 PW

[51] Int. Cl.[2] ..... B65H 54/02

[58] Field of Search ..... 242/18 PW; 57/34 TT

[56] References Cited

UNITED STATES PATENTS 3,237,876 3/1966 Franzen ..... 242/18 PW

FOREIGN PATENTS OR APPLICATIONS 1,806,243 10/1968 Germany ..... 242/18 PW

*Primary Examiner*—Stanley N. Gilreath

*Attorney, Agent, or Firm*—Kenyon & Kenyon Reilly Carr & Chapin

[57] ABSTRACT

The combs which guide the thread to the bobbin tube are moved up and down relative to each other at a frequency at least equal to the rotational speed of the bobbin tube. The thread is initially caused to wind on the bobbin to form a waste bunch with subsequent up and down motion of the combs relative to each other causing a plurality of helically arranged distinctly spaced reserve windings.

9 Claims, 7 Drawing Figures

Fig. 2
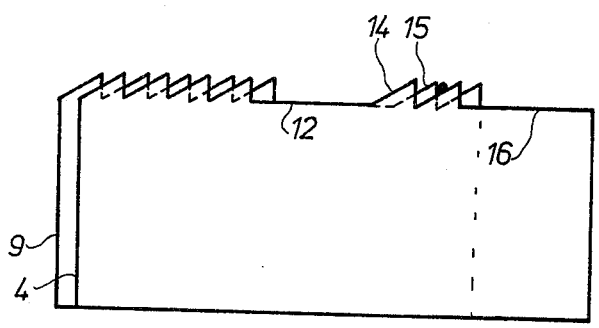
Fig. 3
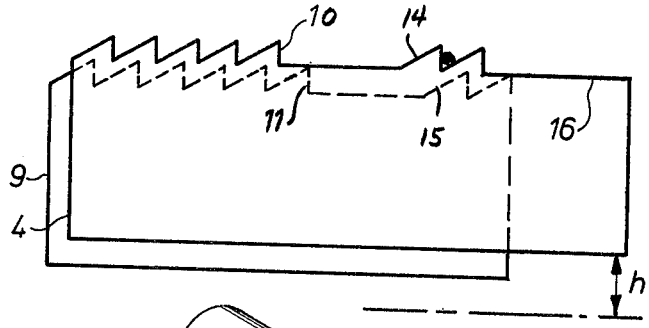
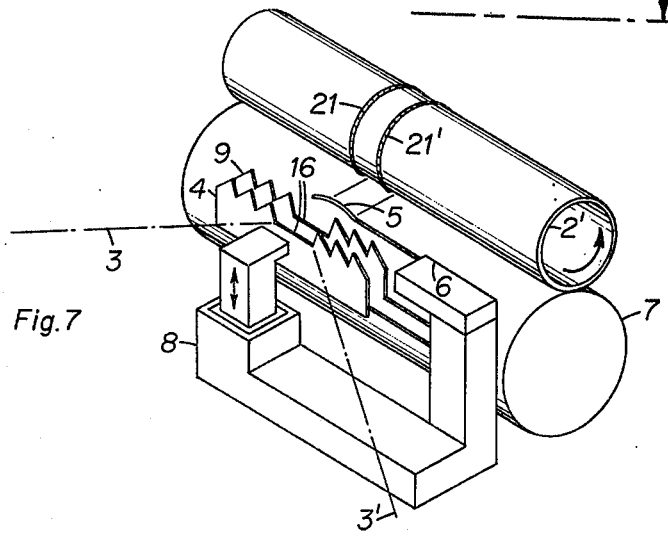
Fig. 7

APPARATUS FOR PRODUCING WASTE AND RESERVE WINDINGS ON BOBBIN TUBES ON WINDING MACHINES

The invention relates to an apparatus for producing waste and reserve windings on bobbin tubes on winding machines.

Devices have been known, such as described in German DAS 1,806,243, for producing thread reserve windings on bobbin tubes on a winding machine by means of a rigidly mounted guide plate provided with teeth and a cooperating thread lifting comb provided with steps. In these devices, the thread lifting comb carries out a traversing movement via a thread traversing device or via a traversing rod provided along the machine in the rhythm of the traversing movement. However, these devices have a disadvantage in that the traversing frequency of the thread lifting comb is low as compared to the rotational speed of the bobbin tube to the extent that the reverse windings are not placed separately side by side on the bobbin tube but are superimposed. Thus, a subsequent removal of such superimposed windings, or bunches respectively, is relatively difficult. Also, in a device described as an alternative design which is to use a thread lifting comb independent of the thread traversing motion, overwrapped windings are generated due to the very geometry of the thread lifting comb or element and the cooperating toothed guide plate. That is, the thread is shifted stepwise in the rhythm of the thread traversing motion towards the center of the bobbin tube in such a manner that the thread is overwrappingly superimposed several times during the dwell periods of the thread lifting comb between the shifting steps.

Accordingly, it is an object of the invention to form a winding arrangement on a bobbin tube adjacent a waste bunch which is free of overwrapped superimposed wraps.

It is another object of the invention to be able to wind reserve windings on a bobbin for subsequent ready removal.

Briefly, the invention provides an apparatus for producing a waste bunch and thread reserve windings on a bobbin tube on a winding machine. The apparatus includes a thread guide comb having a plurality of teeth, or other projections, a thread lifting comb and means for lifting and lowering at least one of the combs at a frequency corresponding at least to the frequency of rotation of the bobbin tube.

The apparatus cooperates with a friction drive drum of the winding machine which drum drives the bobbin tube. The combs are arranged in parallel and guide a thread to the bobbin tube at an inclined angle relative to the bobbin tube while the comb projections serve to guide the thread in spaced paths.

The means for lifting and lowering the combs is in the form of a drive mechanism which is activated by means of a switch having a contacting feeler arm in the thread path. A timing relay is also connected between the switch and drive mechanism for delaying the activation and de-activation of the drive mechanism.

These and other advantages and objects of the invention will become more apparent from the following detailed description when taken in conjunction with the accompanying drawings in which:

FIG. 2 illustrates two combs with a movable comb shown in a middle position in accordance with the invention;

FIG. 3 illustrates the arrangement shown in FIG. 2 with the movable comb being fully lifted;

FIG. 7 illustrates an arrangement of a winding apparatus using the cone of FIG. 6 for a double bobbin package.

Figure 1:
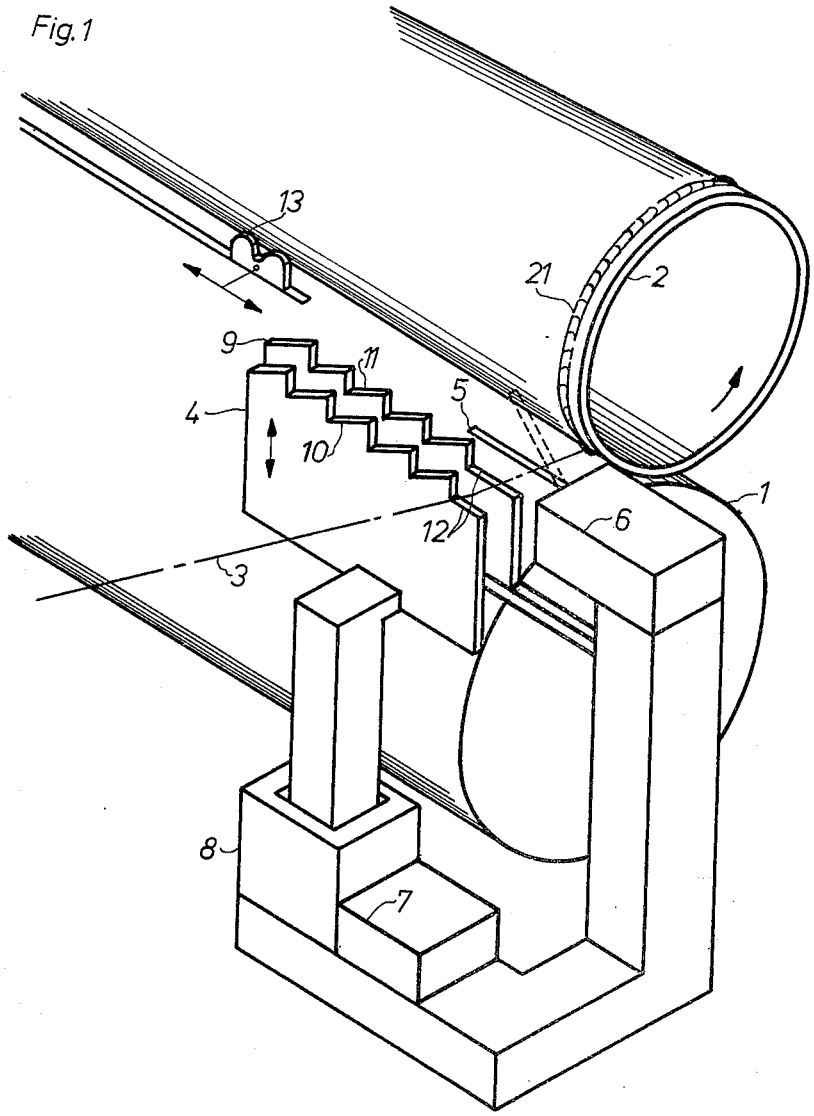
FIG. 1 illustrates an axonometric view of a winding apparatus of a winding machine in accordance with the invention.

Referring to FIG. 1, a winding machine includes, inter alia, a friction drive drum 1 which drives a bobbin tube 2 in contact with the drum 1 as is known. A thread 3 is guided to the bobbin tube 2 at an inclined angle relative to the bobbin tube via any suitable means as is known.

An apparatus for producing a waste bunch and thread reserve windings on the bobbin tube 2 includes a pair of combs 4, 9 which are in parallel and serve to guide the thread 3 to the bobbin tube 2 at an inclined angle relative to the bobbin tube 2. One comb 4 is transversable up and down relative to the thread 3. For this purpose, a means for lifting and lowering the comb 4 includes a drive mechanism 8 of suitable construction which is connected to the comb 4. In addition, a pivotal contacting feeler arm 5 of a switch 6 extends into the path of the thread 3 so as to be pivotable away from the thread path under thread tension. The switch 6 is connected via a timing relay 7 to the drive mechanism 8 so as to activate and de-activate the drive mechanism 8 after a time delay.

The comb 9 is stationary and is located between the movable comb 4 and bobbin tube 2. Both combs 4, 9 are provided along the upper surface with identical projections 10, 11 in the form of inclined teeth and with laterally adjacent input start sections 12. These teeth serve to define a plurality of spaced thread paths to the bobbin tube 2.

In order to move the comb 4, the drive mechanism 8 is constructed so that the traversing frequency of the comb 4 is equal to, or higher than, the number of revolutions per time unit (RPM) of the bobbin tube 2. In one case, the drive 8 can be driven by a power source which operates at the same frequency as the synchronous motor of the friction drive drum drive motor (not shown). The comb 9 can also be provided with a drive mechanism which operates at the same frequency as the comb 4 but in an out-of-phase relation.

A thread traversing guide 13 is used for traversing the thread during normal winding operation.

Referring to FIG. 2, the combs 4, 9 may also be provided with an additional group of projections 14, 15, i.e. teeth, with an additional input start section 16 onto which the thread 3 is placed as the arm 5 is pivoted away.

Figure 4:
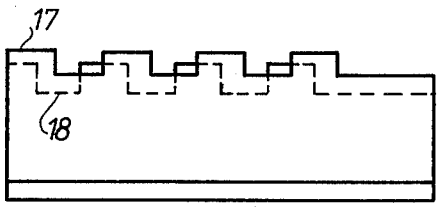
FIG. 4 illustrates a view of an alternative tooth shape in accordance with the invention.

Referring to FIG. 4, the projections on the combs 4, 9 may alternatively be in the form of rectangular teeth 17, 18.

Figure 5:
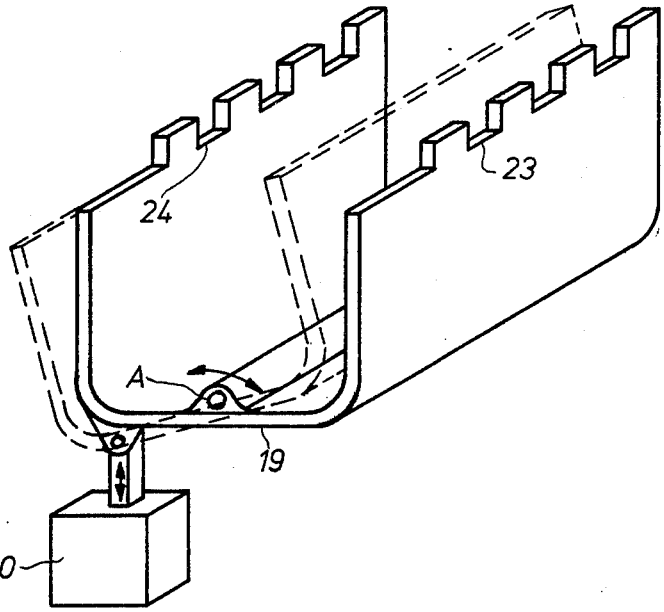
FIG 5 illustrates a view of a modified comb arrangement which is pivotable about a common axis.

Referring to FIG. 5, a pair of combs 23, 24 are mounted on a common element 19 which is pivotally mounted on an axle A or the like and is pivotable about the axle A by a common transversing motion drive 20. The shape of the combs 23, 24 and the projections may correspond to any of the above described shapes of FIGS. 1, 2 and 4.

Figure 6:
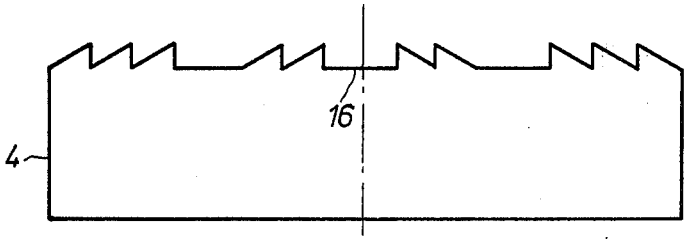
FIG. 6 illustrates a comb for a double bobbin package on a common tube.

Referring to FIGS. 6 and 7 wherein like reference characters indicate like parts as above the apparatus can also be mounted on winding machines producing double bobbin packages (i.e. two separate bobbin packages on one tube).

As shown in FIG. 7, each comb 4, 9 has a tooth arrangement symmetrical with respect to an input start section 16 for simultaneously forming a waste bunch and two reverse windings on a double bobbin tube 2'. In operation, the friction drive drum 1 drives the double bobbin tube 2' and two threads 3, 3' are guided to the bobbin tube 2' at inclined angles relative to the bobbin tube. The two threads 3, 3' lead over the input portion 16 of the combs 4, 9 and the contacting feeler arm 5 of switch 6 to the tube 2'. The apparatus operates similarly as the apparatus described with respect to FIG. 1 but symmetrically on both sides of the input portion 16.

Referring to FIG. 1, in order to produce a waste bunch and reserve windings, the apparatus operates as follows:

As a full bobbin is doffed and an empty tube 2 is donned, the thread 3, having been sucked off during the bobbin change process by a suction device (not shown), is brought in a manner known as such to the bobbin tube 2 and caught on the tube 2. Catching of the thread 3 in this process can be effected e.g. by a notch provided at the face side or on the circumferential periphery of the bobbin tube 2. The incoming thread 3 owing to its inclined direction towards the bobbin tube center slide onto the contacting arm 5. The contacting arm 5 now pivots away and activates the drive mechanism 8 via a timing relay 7 after a time delay in such a manner that the comb 4 starts moving up and down. The thread 3 slides further on the contacting arm 5 to the left as viewed as the arm 5 pivots downwardly. The thread 3 then slides onto the input start section 12 of the comb 4 and, owing to the thread tension component directed towards the center of the bobbin tube 2, slides on the input start section 12 up to the first tooth flank. During the time lapse from the catching of the thread 3 by the tube 2 to the moment in which the thread slides to the first tooth flank, a waste bunch 21 is formed on the bobbin tube 2. The size of the waste bunch 21 in this arrangement can be chosen freely by setting the timing relay 7 which activates the drive mechanism 8 of the comb 4. Owing to the relative movement of the teeth 10, 11 of the two combs 4 and 9, the thread is now placed from one tooth to the next in such a manner that the thread, slides along the tooth flank into the tooth bottom of each tube portion in the direction towards the bobbin tube center. A number of helically arranged windings corresponding to the number of teeth is thus generated on the bobbin tube 2. Upon passing along the last tooth of the toothed section, the thread 3 automatically slides into a traversing thread guide 13 of the thread traversing device and the formation of normal package windings is started. The timing relay 7 which activates the drive mechanism 8 to move the comb 4 also serves to de-activate the drive mechanism 8 at this time.

Using the combs shown in FIGS. 2 and 3, each provided with two groups of teeth and input start sections, the thread 3 remains caught during the time lapse from the activation of the comb drive mechanism 8 until the comb 4 has reached the lift $h$ (FIG. 3) on the group of teeth 14, 15 and is wound onto the bobbin tube 2 as a waste bunch 21. Retaining the thread until the full lift $h$ is reached ensures that all subsequently formed reserve windings are distinctly placed side by side and that no thread is divided i.e. split by a tooth point due to incomplete lifting of the tooth or is wound onto the preceding winding.

In the embodiment according to FIG. 5, the combs 23, 24 are pivoted about the axle A relative to the horizontal plane to effect a relative up and down traversing motion of the two combs 23, 24.

By simply exchanging combs of different tooth width and tooth number, the helix angle and the number of the reserve windings with the described apparatus can be adapted in a most simple manner to the thread count or weight. Also, the position of the reserve windings can be adapted as required in a simple manner.

A further advantage of the invention is seen in that the formation of the thread reserve windings and of the waste bunch are effected independently from the higher or lower thread tension applied. Thus, on the same winding position as well as on all other winding positions, the same waste bunches and reserve windings can always be generated uniformly.

What is claimed is:

1. An apparatus for producing a waste bunch and thread reserve windings on a bobbin tube on a winding machine, said apparatus including
   - a thread guide comb having a plurality of teeth thereon;
   - a thread lifting comb having a plurality of teeth identical to said teeth of said guide comb;
   - each said comb having a tooth arrangement symmetrical with respect to an input start section for simultaneously forming a waste bunch and two reserve windings for double packages on a common tube; and
   - means for lifting and lowering at least one of said combs at a frequency corresonding at least to the frequency of rotation of the bobbin tube.

2. An apparatus as set forth in claim 1 which further includes a contacting feeler member for activating and deactivating the lifting and lowering traversing motion of said combs.

3. An apparatus as set forth in claim 2 which further includes a timing relay connectable to said contacting feeler member for activating and for re-activating the lifting and lowering traversing motion of said combs.

4. An apparatus as set forth in claim 1 wherein said combs are exchangeable.

5. In combination with a winding machine having a friction drive drum for driving a bobbin tube contacting said drum;
   - a first comb for guiding a thread to said bobbin tube at an inclined angle relative to said bobbin tube, said comb having a plurality of projections thereon for guiding of the thread in spaced paths to said bobbin tube;
   - a second comb parallel to said first comb and located between said first comb and said bobbin tube for guiding the thread to said bobbin tube;
   - a drive mechanism for moving said first comb up and down relative to said second comb and said paths at a frequency at least equal to the rotational speed of said bobbin tube to permit lifting of the thread from said combs in an alternating manner and movement of the thread into an adjacent one of said paths;

a switch having a contacting arm in the path of the thread for activating and thereafter de-activating said drive mechanism in response to movement of the thread into a respective one of said paths; and, a timing relay connected between said switch and said drive mechanism for delaying the activation and de-activation of said drive mechanism.

6. The combination as set forth in claim 5 wherein said second comb is stationary.

7. The combination as set forth in claim 5 wherein said combs are mounted on a common pivotally mounted element, said element being connected to said drive mechanism.

8. The combination as set forth in claim 5 wherein said combs have an identical plurality of projections thereon, said projections of one comb being displaced laterally to said projections of the other comb relative to said paths.

9. The combination as set forth in claim 8 wherein each comb has two groups of spaced apart projections with a smooth surface therebetween.

* * * * *